United States Patent [19]

Komorita et al.

[11] Patent Number: 4,837,143

[45] Date of Patent: Jun. 6, 1989

[54] SILVER HALIDE PHOTOGRAPHIC LIGHT-SENSITIVE MATERIAL

[75] Inventors: Kazuo Komorita; Kaoru Onodera, both of Odawara, Japan

[73] Assignee: Konishiroku Photo Industry Co., Ltd., Tokyo, Japan

[21] Appl. No.: 292,650

[22] Filed: Dec. 29, 1988

Related U.S. Application Data

[63] Continuation of Ser. No. 38,224, Apr. 14, 1987, abandoned.

[30] Foreign Application Priority Data

Apr. 24, 1986 [JP] Japan ..... 61-95021

[51] Int. Cl.[4] ..... G03C 1/30; G03C 1/06

[52] U.S. Cl. ..... 430/621; 430/605; 430/613; 430/614; 430/626

[58] Field of Search ..... 430/605, 613, 614, 621, 430/626

[56] References Cited

U.S. PATENT DOCUMENTS

| | | | |
|---|---|---|---|
| 4,621,041 | 11/1986 | Saikawa et al. | 430/605 |
| 4,647,528 | 3/1987 | Yamada et al. | 430/621 |
| 4,661,441 | 4/1987 | Kajiwara et al. | 430/626 |
| 4,670,377 | 6/1987 | Miyoshi et al. | 430/621 |

FOREIGN PATENT DOCUMENTS 23248 5/1982 Japan .

*Primary Examiner*—Mukund J. Shah

*Attorney, Agent, or Firm*—Jordan B. Bierman

[57] ABSTRACT

A silver halide photographic light-sensitive material comprising a support bearing at least one silver halide emulsion layer is disclosed. The silver halide emulsion layer contains silver halide grains comprising not less than 80 mol% of silver chloride and a water soluble iridium compound in an amount of from $10^{-8}$ to $10^{-5}$ mol per mol of a silver halide contained in the emulsion layer. And the emulsion layer is hardened with a hardner represented by General Formula [I] or [II].

General Formula [I]

General Formula [II]

The photographic material has an excellent antipressure property and suitable for a rapid processing.

13 Claims, No Drawings

SILVER HALIDE PHOTOGRAPHIC LIGHT-SENSITIVE MATERIAL

This application is a continuation of application Ser. No. 038,224, filed Apr. 14, 1987, now abandoned.

FIELD OF THE INVENTION

This invention relates to a silver halide photographic light-sensitive material and the process of preparing the same and, more particularly, to a silver halide photographic light-sensitive material capable of displaying an excellent antipressure effect and suitable for rapid processing and the process of preparing the same.

BACKGROUND OF THE INVENTION

In the processes of forming a dye image ordinarily by making use of a silver halide color photographic light-sensitive material, the dye image is formed in such a manner that the light-sensitive material is imagewise exposed to light and dye image may be formed upon reacting an oxidized p-phenylenediamine type color developing agent with a dye image forming coupler. In the above-mentioned processes, a subtractive color method is normally applied for reproducing colors, so that cyan, magenta and yellow dye images corresponding to red, green and blue are formed on the respective light-sensitive layers. In recent years, when forming such a dye image as mentioned above, a highly active development using a high pH, high temperature and high concentration type color developing agent and the ommission of some processing steps have popularly been tried with the purpose of saving a processing time. It is particularly essential to improve the rate of development in a color developing step so as to saving the developing time required for the above-mentioned highly active development.

Accordingly, in recent years, many measures have been taken to rapidly perform a color development. As one of the measures, it has been well known that a development accelerator is used when an exposed silver halide color photographic light-sensitive material is developed by making use of an aromatic primary amine type color developing agent. Among the development accelerators, the compounds endowed with a relatively higher activity have a disadvantage that a fog is often produced. In the meantime, even among the above-mentioned compounds, some kind of black-and-white developing agents displaying a superadditivity in a color development may be able to display a development accelerating effect with a relatively less fog poduction as compared with other development accelerators.

Such black-and-white developing agents include, for example, an 1-phenyl -3-pyrazolidone described in British Pat. No. 811,185, an N-methyl-p-aminophenol described in U.S. Pat. No. 2,417,514, an N,N,N',N',-tetramethyl-p-phenylene-diamine described in Japanese Patent Publication Open to Public Inspection (hereinafter called Japanese Patent O.P.I. Publication) No. 15554/1975, and so forth.

The superadditive development mechanism for color development has been reported by G.F. Van Veelen in "Journal of the Photographic Science", No. 20, p. 94, (1972). In the cases of obtaining a color development accelerating effect by making use of the above-mentioned black-and-white developing agent as an auxiliary developer, there is one case where such a black-and-white developing agent is contained in advance in a silver halide color photographic light-sensitive material or another case where the black-and-white developing agent is contained in a color developer.

Among the above-mentioned cases, in the case that the above-mentioned black-and-white developing aent is contained in a silver halide photographic light-sensitive material so as to accelerate the color development thereof, an 1-aryl-3 pyrazolidone, in particular, is preferably used. For example, Japanese Patent O.P.I. Publication No. 89739/1981 discloses that an 1-aryl-3-pyrazolidone is added to a silver halide color photographic light-sensitive material comprising a support bearing thereon silver halide emulsion layers containing silver halide grains different among the layers by 50% or more in terms of grain size ratios. However, the silver halide color photographic light-sensitive materials each containing an 1-aryl-3-pyrazolidone disclosed in the above-mentioned Patent Publication are to be treated in an intensifying process in the presence of such an intensifier as a cobalt complex salt. It was, therefore, found that, if they are treated in a normal color developing process, they will display the development accelerating effect very poorly and, in particularly, if they are treated in a normal color developing process by making use of silver halide emulsions each having a relatively large average grain size, almost no color development accelerating effect can be displayed.

Besides the above, Japanese Patent O.P.I. Publication No. 64339/1981 discloses a process in which an 1-aryl-3-pyrazol-idone having a specified structure is added into a silver halide color photographic light-sensitive material; and Japanese Patent O.P.I. Publication Nos. 144547/1982, 50532/1983, 50533/1983, 50534/1983, 50535/1983, and 50536/1983 each disclose the respective processes in which an 1-aryl-3-pyrazolidone is added into a silver halide color photographic light-sensitive material so as to develop the material within a substantially very short period of time.

The techniques disclosed in the above-mentioned patent publications may be satisfiable as far as a development accelerating effect is concerned, however, these techniques are not always satisfiable if they are evaluated in general terms including the photographic characteristics such as sensitivity, gradation, maximum density and so forth.

On the other hand, with respect to the silver halide emulsions each containing silver halide grains, which are used in silver halide photographic light-sensitive materials, it has already been proved that the configurations, sizes and compositions of the silver halide grains will substantially influence a developing rate, and many studies have so far been made. From these studies, it has also been proved that silver chloride grains will exhibit a substantially high developability under some specific condition and silver halide grains are advatageously used because they have less disadvantages than the aforementioned development accelerators have. The techniques of using silver cloride grains are described in, for example, Japanese Patent O.P.I. Publication Nos. 135832/1980, 16589/1980, 125612/1983 and 107532/1983; Japanese Patent Examined Publication No. 56055/1982; and so forth. However, silver chloride grains have such a disadvantage as is poor in antipressure effect, while they have a particularly excellent developability as compared with the other silver halide grains.

The antipressure effect of silver halide grains will now be described below:

Generally, various pressures are applied to light-sensitive materials. In the course of manufacturing light-sensitive materials, a great pressure is applied to such light-sensitive materials in a cutting step, for example.

Besides the above, when using light-sensitive materials and, particularly, sheet-type light-sensitive materials, they may often be bent because they are handled by hand and a pressure is applied to the bent portions of the materials.

On the other hand, it has become populerized in recent years that light-sensitive materials have been automatically exposed to light by a printer and have also been treated in an automatic development process by an automatic processor. Accordingly, there have been increased opportunities to apply mechanical pressures to light-sensitive materials inside the above-mentioned apparatuses. When a variety of pressures are applied to light-sensitive materials, as mentioned above, the pressures are also applied to the silver halide grains of such light-sensitive materials through gelatin that is the binder of the silver halide grains. When the pressure is applied to the silver halide grains, the photographic characteristic of the light-sensitive materials are varied so as to produce phenomena such as a pressure desensitization, a pressure fog and so forth. These kinds of phenomena have so far been well-known as the so-called photographic pressure effects such as described in, for example, T.H. James, 'The Theory of the Photographic Process', 4th Edition, The Macmillan Co., New York, Article 24; D. Dautrich, F. Granzer and E. Moiser, 'Journal of Photographic Science', No. 21, p. 221, 1973; and so forth.

It is also well-known in this field of the at that the greater in both grain-size and sensitivity silver halide grains are, the higher the sensibility for pressure is as well as the more a pressure desensitization or a pressure fog may be liable to produce.

Further, there are two cases of applying a pressure to a light-sensitive material, one is in a dry state and another is in a wet state where a development is being carried out. Therefore, any light-sensitive material cannot be fully satisfied until the antipressure effect thereof is improved in both of the above-mentioned two states.

There have so far been attempts to provide light-sensitive materials relatively less affected by pressure.

The well known methods of improving such antipressure effects include, for example, a method in which such a plasticizer as a polymer is contained into a light-sensitive material, another method in which a proportion of a silver halide content to a gelatin content is made lower, and so forth.

For example, British Patent No. 738,618 discloses a method in which a heterocyclic compound is used; British Patent No. 738,637 discloses a method in which an alkyl phthalate is used; British Pat. No. 738,639 discloses a method in which an alkyl ester is used; U.S. Pat. No. 2,960,404 discloses a method in which a polyvalent alcohol is used; U.S. Pat. No. 3,121,060 discloses a method in which a carboxyalkyl cellulose is used; Japanese Patent O.P.I. Publication No. 5017/1974 discloses a method in which paraffin and a carboxylate are used; Japanese Patent Examined Publiction No. 28086/1978 discloses a method in which an alkyl acrylate and an organic acid are used; and so forth.

However, the above-mentioned techniques have the disadvantages, for example, that the antipressure effects are not satisfactory in both dried and wet states and that the characteristics of the binder used such as the tackiness and dryness of the surface of a light-sensitive material and so forth are seriously deteriorated.

In addition to the above, the methods of improving the antipressure characteristics of silver halide grains include, for example, a method disclosed in Japanese Patent Examined Publication No. 23248/1982 in which an mercapto compound and a water-soluble iridium compound are to be added to a silver halide in the course of forming silver halide grains; another method disclosed in U.S. Pat. No. 3,622,318 in which a denatured emulsion which was surface-sensitized is used; and so forth. However, with the above-mentioned techniques, it is hard to enjoy a satisfactory antipressure effect in both dried and wet states.

Further, with the techniques, the antipressure effect is deteriorated relatively as the sensitivity of a light-sensitive material is getting faster or the grain sizes of silver halide grains is getting larger.

Accordingly, any of the conventional techniques cannot satisfactorily be effective to maintain the ascendance of silver chloride grains as well as to improve the antipressure effects in both dried and wet states and, therefore, a further improvement has been required.

SUMMARY OF THE INVENTION

It is, therefore, an object of the invention to provide a silver halide photographic light-sensitive material excellent in antipressure effect in both dried and wet states as well as suitable for a rapid processing and the process of manufacturing the same.

Other objects of the invention will be apparent from the following description.

The above-mentioned objects of the invention can be achieved by the following;

A silver halide photographic light-sensitive material comprising a support bearing thereon at least one silver halide emulsion layer, wherein the silver halide emulsion layer comprises silver halide grains comprising not less than 80 mol% of silver chloride and a water soluble iridium compound in an amount of from $10^{-8}$ to $10^{-5}$ mol per mol of a silver halide contained in the silver halide emulsion layer, and the silver halide emulsion layer is hardened with at least one selected from the group consisting of the compounds each represented by the following General Formula [I] and the compounds each represented by the following General Formula [II]:

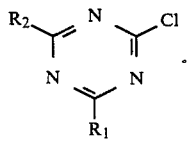

General Formula [I]

[wherein $R_1$ represents a chlorine atom, a hydroxy group, an alkyl group, an alkoxy group, an alkylthio group, an —OM group (in which M represents a monovalent metal atom), an —NR'R" group (in which R' and R" represent each a hydrogen atom, an alkyl group or an aryl group), or an —NHCOR'" group (in which R'" represents a hydrogen atom, an alkyl group or an aryl group); and $R_2$ represents one of the groups synonymous with those represented by the above-mentioned $R_1$ except a chlorine atom.]

General Formula [II]

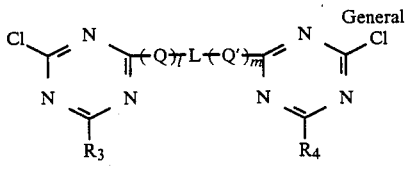

[wherein $R_3$ and $R_4$ represent each a chlorine atom, a hydroxy group, an alkyl group, an alkoxy group or an —OM group (in which M represents a monovalent metal atom); Q and Q′ represent each a coupling group indicating —O—, —S—or —NH—; L represents an alkylene group or an arylene group; and and m represent each 0 or 1.] At least one of the above-mentioned silver halide emulsion layers contains silver halide grains each having a silver chloride content of not less than 80 mol% and such silver halide grains are preferably those formed in the presence of a water-soluble iridium compound in an amount of from $10^{-8}$ to $10^{-5}$ mol per mol of the silver halide used.

DETAILED DESCRIPTION OF THE INVENTION

In the invention, at least one of the silver halide emulsion layers thereof comprises silver halide grains each having a silver chloride content of not less than 80 mol% (hereinafter referred to as silver halide grains relating to the invention) and, more preferebly, having a silver chloride content of not less than 90 mol%. The silver iodide content of each of the silver halide grains is not more than 1 mol% and, more preferably, not more than 0.5 mol%. Such silver halide grains are, more preferably, silver chlorobromide grains each having a silver bromide content of not more than 10% or silver chloride grains.

Such silver halide grains relating to the invention may be used independently or in combination. They may further be used in the form of a mixture together with other silver halide grains having any different compositions from theirs. They may further be used together with any silver halide grains each having a silver chloride content of less than 80 mol%.

Silver halide grains each having a silver chloride content of not less than 80 mol% are to be at least 50% by weight and, more preferably, at least 75% by weight of the whole silver halide grains being contained in a silver halide emulsion layer containing silver halide grains each having a silver chloride content of not less than 80 mol%.

The silver halide grains relating to the invention may be used in any forms thereof. One of the preferable examples thereof is of a cubic system having the crystal faces of {100} plane. It is also allowed to use the silver halide grains having an octahedral, tetradecahedral, dodecahedral crystal forms and so forth which may be prepared in such a processes as described in the literatures such as U.S. Pat. Nos. 4,183,756 and 4,225,666, Japanese Patent O.P.I. Publication No. 26589/1980, Japanese Patent Examined Publication No. 42737/1980, The Journal of Photographic Science, No. 21, 39 (1973), and so forth. Besides the above, grains in a twinned crystal form may also be used.

It is furthe allowed to use the silver halide grains relating to the invention which are either in the same grain form or in the mixture of various grain forms.

The composition of the silver halide grains relating to the invention may be uniform from the inside upto the outside thereof or may also be different between the inside and the outside thereof. If the composition of the inside of grains from the outside thereof, such composition may be varied continuously or discontinuously therebetween.

There is no special limitaltion to the grains sizes of the silver halide grains relating to the invention, however, when taking the rapid processability, sensitivity or other photographic characteristics into consideration, the range of such grain sizes is, preferably, from 0.2 to 1.6 μm and, more preferably, from 0.25 to 1.2 μm. The above-mentioned grain sizes may be measured in various methods popularly used in the art of this field. The typical methods are described in, for example, 'Particle size Analysis' R.P. Loveland, ASTM Symp. on Light Microscopy, 1955, pp. 94–122 or Mees and James, The Theory of the Photographic Process, 3rd Ed., The Macmillan Co., 1966, Chapter 2.

The above-mentioned grain sizes can be measured by making use of the projective areas of the grains or the approximate values of diameters. When grains are substantially uniform in configuration, a considerably precise grain distribution may be expressed in terms of a diameter or a projective area.

The grain size distribution of the silver halide grains relating to the invention may be either of the polydisperse type or of the monodisperse type. The preferable silver halide grains are monodisperse type silver halide grains each having such a variation coefficient of the grain distribution thereof as is, preferably, not more than 0.22 and, more preferably, not more than 0.15. The term, a variation coefficient, is a coefficient representing an extent of a grain distribution and is hereby defined by the following formulas:

$$\text{Variation coefficient } (S/r) = \frac{\text{Standard deviation of grain distribution}}{\text{Average grain size}}$$

$$\text{Std. deviation } (S) \text{ of grain distribution} = \sqrt{\frac{\Sigma (\bar{r} - ri)^2\, ni}{ni}}$$

$$\text{Average grain size } (\bar{r}) = \frac{\Sigma niri}{\Sigma ni}$$

Wherein ri represents the grain size of an individual grain, ni represents a number of grains. The term, grain size, expressed herein means the diameter of a silver halide grain if the grain is in the spherical form or the diameter of a circular image having the same area with the area of the projective image of a silver halide grain if the grain is in the cubic form or in any other forms than the cubic form.

Into the silver halide grains relating to the invention, a water-soluble iridium compound is further added in an amount of from $10^{-8}$ to $10^{-5}$ mol per mol of silver halide used.

The iridium compounds capable of being used in the invention include, for example, a water-soluble iridium salt or a water-soluble iridium complex salt such as, typically, an iridium trichloride, iridium tetrachloride, potassium hexa-chloroiridate (III), potassium hexachloroiridate (IV), ammonium hexachloroiridate (IV) and so forth, which may preferably be used in the invention.

An amount of the water-soluble iridium compounds to be added is from $10^{-8}$ to $10^{-5}$ mol of a silver halide used, as described above. Within the above-mentioned range, an optimum amount added thereof is suitably selected by taking into considerations of the grain sizes and crystal habits of silver halide grains and further the combination use with other additives such as spectral sensitizers and so forth. Generally speaking, if the amount added thereof is less than $10^{-8}$ mol, the effects of the invention will not satisfactorily by enjoyed and if exceeding $10^{-5}$ mol, there may be some instances where the other photographic characteristics such as desensitization effects and so forth may be affected.

There is no special limitation to the point of time of adding the above-mentioned water-soluble iridium compound into a silver halide emulsion. It is, however, preferable that the silver halide grains of the silver halide emulsion are to be formed in the presence of the water-soluble iridium compound.

The above-mentioned water-soluble iridium compounds capable of being used in the invention may be added in any steps such as those of the formation, growth or physical ripening of the nuclei of the silver halide grains relating to the invention having the above-mentioned silver chloride content of not less than 80 mol%, or they may also be added by dividing into the parts thereof. Such water-soluble iridium compounds are used after they are dissolved in water or an appropriate solvent. For the purpose of stabilizing such an iridium compound solution, the methods which are popularly applied, namely, a method of adding a hydrogen halide solution (such as those of hydrochloric acid, hydrobromic acid, hydrofluoric acid or the like) or an alkali halide solution (such as those of KCl, NaCl, Na Br or the like).

The silver halide grains capable of being used in the invention may be prepared in any of an acid process, a neutral process and an ammonia process, either. Such grains may also be grown either at the same time altogether or after preparing the seed grains thereof. The process of preparing the seed grains and the process of growing them up may be the same with or the different from each other.

The processes of reacting a soluble silver salt with a soluble halide include any one of a normal precipitation process, a reverse precipitation process, a double-jet precipitation process, the combinations thereof and so forth and, more preferably, the double-jet precipitation process. It is also allowed to use one of the double-jet precipitation processes, namely, a pAg-controlled double-jet process described in Japanese Patent O.P.I. Publication No. 48521/1979 and so forth.

It is also allowed, if required, to use such silver halide solvents as thioether and so forth or such crystal habit controllers as a mercapto group-containing organic compound and a spectral sensitizer.

The silver halide grains relating to the invention may be those capable of forming a latent image mainly on the surface thereof or those capable of forming a latent image mainly inside the grains.

In order to satisfactirily display the effects of the invention, it is preferable to avoid to use any silver halide grains of such a type that the internal latent image may mainly be formed in such a state where a chemical sensitization is applied to silver halide grains being grown in the course of forming the grains before the silver halide grains are ultimately completed, but any chemical sensitization is not yet applied to the completed grains surfaces. Whether a silver halide grain is of the internal latent image type or not may be judged in such a method as described, for example, in Japanese Patent Examined Publication No. 34213/1977.

To be more concrete, a given emulsion is coated in the terms of silver coated in an mount of about 300 to 400 mg/ft$^2$ over to a polyethylene-coated support. The resulted samples were divided into two pieces each of which was exposed to light of a 500W tungten lamp for a fixed period of time from $1\times10^{-2}$ to 1 sec through a light-intensity scale, respectively. One of the sample was developed with the following developer Y (i.e., an internal type developer) at 18.3° C. for 5 min. The other sample was developed with the following developer X (i.e., a surface type developer) at 20° C. for 6 min.

In this case, it is preferred for the invention to use the silver halide grains each having a ratio of a maximum desnity obtained after an internal development to a manimum density obtained after a surface development is to be not greater than 5 and, more preferably, not greater than 2.

| | |
|---|---|
| **Developer X** | |
| N—methyl-p-aminophenol sulfate | 2.5 g |
| Ascorbic acid | 10.0 g |
| Potassium metaborate | 35.0 g |
| Potassium bromide | 1.0 g |
| Water to be added to make | 1 liter |
| | (pH = 9.6) |
| **Developer Y** | |
| N—methyl-p-aminophenol sulfate | 2.0 g |
| Sodium sulfite, (Anhydrous) | 90.0 g |
| Hydroquinone | 8.0 g |
| Sodium carbonate.1$H_2O$ | 52.5 g |
| Potassium bromide | 5.0 g |
| Potassium iodide | 0.5 g |
| Water to be added to make | 1 liter |
| | (pH = 10.6) |

The above-mentioned silver halide emulsion containing the silver halide grains relating to the invention in an amount of from $10^{-8}$ mol to $10^{-5}$ mol per mol of silver halides and the abouv-mentioned water-soluble iridium compounds (hereinafter referred to as a silver halide emulsion of the invention) is allowed to remove an unnecessary soluble salts therefrom after the completion of the growth of the silver halide grains or to remain unremoved as it is. When removing the salts, the removal may be carried out in accordance with such a method as described in Research Disclosure No. 17643, for example.

The silver halide emulsions of the invention may be chemically sensitized in an ordinary process, namely, a sulfur sensitization process using a sulfur-containing compound capable of reacting with silver ions or an active gelatin, a selenium sensitization process using a selenium compound, a reduction-sensitization process using a reducing substance, a noble metal sensitization process using a gold or other noble metal compound and so forth can be used independently or in combination.

The silver halide emulsions of the invention may also be spectrally sensitized to a desired wavelength region by making use of such a dye as is so-called a spectral sensitizer which has been well-known in the art. such a spectral sensitizer may be used independently or in combination. The emulsions of the invention are further allowed to contain such a dye as is incapable of displaying any spectral sensitizing property by itself or such a compound as is incapable of substantially absorbing any visible rays of light, each of which is so-called a supersensitizer capable of increasing the sensitizing property of a spectral sensitizer used.

With the purposes of preventing the silver halide emulsions of the invention from occurring any fog and/or keeping the photlgraphic characteristics thereof stabe in the course of manufacturing, preserving or processing them, such a compound as is so-called an antifoggant or a stabilizer having been well-known in the art may be added thereto, in the course of chemical sensitization process and/or at the point of time when the chemical sensitization process is completed, and/or by the point of time when the silver halide emulsion of the invention is about to be coated after a chemical sensitization process is completed.

In the silver halide emulsions of the invention, the mercapto heterocyclic compounds each represented by the following General Formula [A] may preferably be used for the purpose of displaying the effects of the invention effectively.

General Formula [A]

$Z_0$—SH

[Wherein $Z_0$ represents a heterocyclic residual group.]

The heterocyclic residual groups each represented by the above-given General Formula [A] are allowed to have such a substituent as an alkyl group, an aryl group, an alkenyl group, a sulfamoyl group, a carbamoyl group, an acyl group and so forth.

Among the mercapto heterocyclic compounds which may be used in the invention each represented by the above-given General Formuls [A] include, preferably, such a mercapto heterocyclic compound as can be represented by the following General Formula [A].

General Formula [A-a]

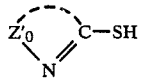

[Wherein $Z_0'$ represents a group of atoms necessary for completing such a heterocyclic ring as an imidazoline ring, an imidazole ring, an imidazolone ring, a pyrazoline ring, a pyrazole ring, a pyrazolone ring, an oxazoline ring, an oxazole ring, an oxazolone ring, a thiazoline ring, a thiazole ring, a thiazolone ring, a selenazoline ring, a selenazole ring, a selenazolone ring, an oxadiazole ring, a thiadiazole ring, a triazole ring, a tetrazole ring, a benzimidazole ring, a benzthiazole ring, an indazole ring, a benzoxazole ring, a benzthiazole ring, a benzselenazole ring, a pyrazine ring, a pyrimidine ring, a pyridazine ring, a triazine ring, an oxazine ring, a thiazine ring, a tetrazine ring, a quinazoline ring, a phthalazine ring, such a polyazaindene ring. (as a triazaindene ring, a tetrazaindene ring, a pentazaindene ring and so forth), and the like rings.]

The heterocyclic residual groups each represented by the

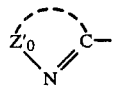

of the above-given General Formula [A-a] are also allowed to have the same substituents as those represented by $Z_0$ denoted in the aforegiven General Formula [A].

The mercapto heterocyclic compounds each represented by the General Formula [A-a] include, preferably, a mercapto-triazole compound having a triazol ring.

The typical examples of the compounds which may be used in the invention each represented by the aforegiven General Formula [A] will be given below. It is, however, to be understood that the invention shall not be limited thereto.

Exemplified Mercapto Heterocyclic Compounds

A-1

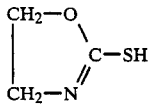

A-2

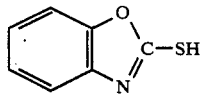

A-3

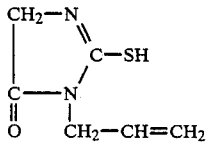

A-4

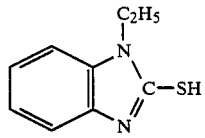

A-5

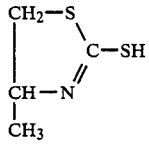

A-6

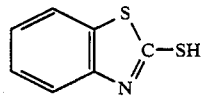

A-7

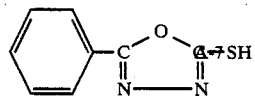

A-8

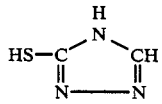

A-9

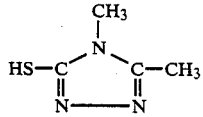

A-10

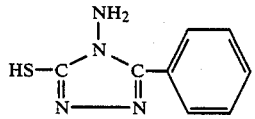

-continued

Exemplified Mercapto Heterocyclic Compounds

A-11

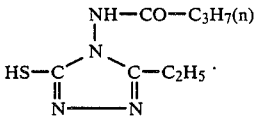

A-12

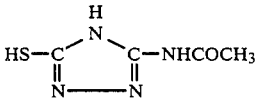

A-13

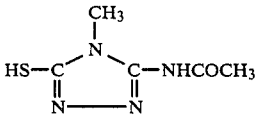

A-14

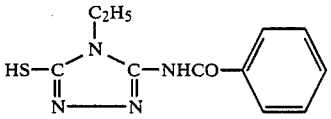

A-15

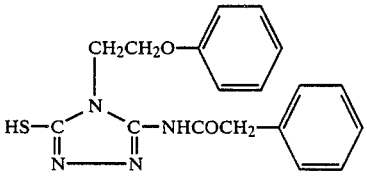

A-16

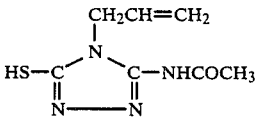

A-17

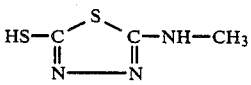

A-18

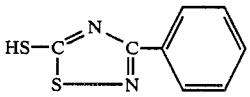

A-19

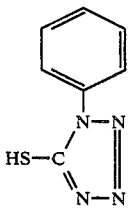

A-20

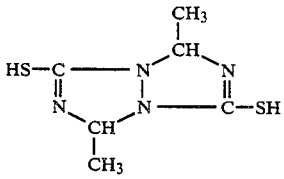

A-21

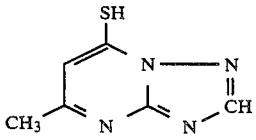

-continued

Exemplified Mercapto Heterocyclic Compounds

A-22

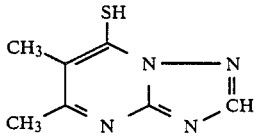

The mercapto heterocyclic compounds preferably used in the invention each represented by the General Formula [A] are described in, for example, Japanese Patent O.P.I. Publication Nos. 42974/1973 and 51666/1982, Japanese Patent O.P.I. Publication No. 102621/1972, French Pat. Nos. 701,053, 701,301 and 1,563,019, U.S. Pat. No. 3,457,078, The Journal of Photographic Science, No. 19, pp. 83-87, and so forth.

An amount added of the mercapto heterocyclic compounds preferably used in the invention is varied according to the conditions of silver halide emulsions such as the silver chloride contents, grain sizes, crystal forms and so forth, however, an excellent result may be displayed when it is added in an amount of from $1\times10^{-6}$ to $1\times10^{-2}$ mol per mol of a silver halide used and, more preferably, in the order of from $1\times10^{-5}$ to $1\times10^{-3}$ mol. They are added in the methods of adding an ordinary photographic additives such as a method in which they are dissolved in water, an acidic or alkaline solution having an appropriate pH value or such an organic solvent as methanol, ethanol and so forth and the resulting solution is then added to a silver halide emulsion.

The mercapto heterocyclic compounds preferably used in the invention may be added independently or in combination and may further allowed to be added thereto upon adding other compounds having been well-known in the photographic art as the so-called antifoggants or stabilizers.

Where to add the mercapto heterocyclic compounds preferably used in the invention may be any one of silver halide emulsion layers of the invention each having a silver chloride content of not less than 80 mol% and/or any one of other photographic component layers than the above-mentioned emulsion layers so as to display the effects and, in particular, the above-mentioned silver halide emulsion layers of the invention each having a silver chloride content of not less than 80 mol% are preferably used. The point of time when adding the mercapto heterocyclic compounds into such a silver halide emulsion layer as mentioned above is not specially be limited but they may be added, preferably, from the point of time when completing a chemical sensitization process to the point of time immediately before a silver halide emulsion is about to be coated over. The addition of the same may be made at one time or may be made separately in lots.

In the invention, the above-mentioned silver halide emulsions of the invention are hardened by making use of at least one of the compounds selected from the group consisting of the compounds each represented by the General Formula [I] and the compounds each represented by the General Formula [II].

The compounds used in the invention each represented by the General Formulas [I] or [II] will now be described in detail.

In General Formulas [I] and [II], both of the alkyl groups and the alkyl components of the alkoxy or alkylthio groups each represented by $R_1$ include, for example, such an alkyl group having 1 to 3 carbon atoms as a methyl group, an ethyl group, a methoxy group, an ethoxy group, a methylthio group, an ethylthio group and so forth.

M represented by the monovalent metal atom of an —OM group represented by $R_1$ include, for examplem sodium, potassium, ammonium and so forth, and the alkyl groups represented by R′ and R″ each of an —NR′R″ group include, for example, an alkyl group having 1 to 3 carbon atoms such as a methyl group, an ethyl group and so forth, and further the aryl groups include, for example, a phenyl group.

The alkyl and aryl groups each represented by R‴ of the —NHCOR‴ group represented by $R_1$ are synonymous with the alkyl and aryl groups represented respectively by the above-mentioned R′ and R″.

$R_2$ is synonymous with the groups repersented by the above-mentioned $R_1$ except a cholrine atom, as aforementioned.

Next, the groups each represented by $R_3$ and $R_4$ are the same groups as those represented by the $R_1$. And, the alkylene groups represented by L include, for example, an alkylene group having 1 to 3 carbon atoms such as a methylene group, an ethylene group and so forth. Further, the Arylene groups include, for example, a phenylene group.

Next, the typical examples of the compounds relating to the invention each repersented by the aforegiven General Formulas [I] and [II] will now be given below.

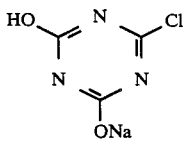
(I-1)

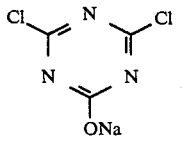
(I-2)

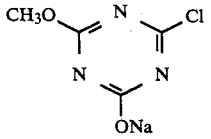
(I-3)

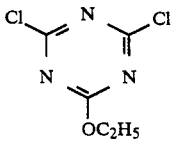
(I-4)

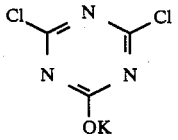
(I-5)

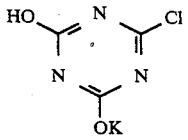
(I-6)

-continued

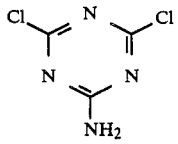
(I-7)

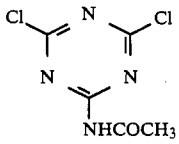
(I-8)

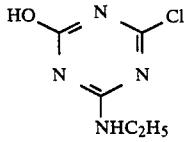
(I-9)

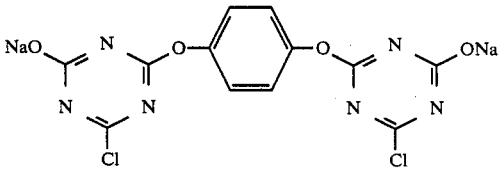
(II-1)

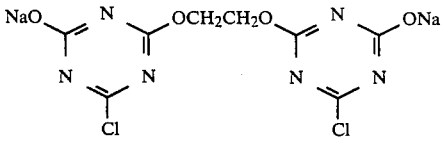
(II-2)

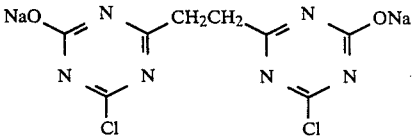
(II-3)

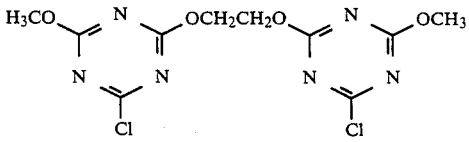
(II-4)

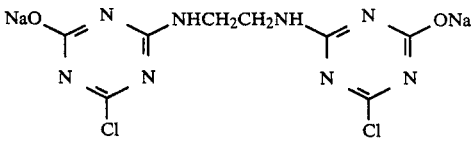
(II-5)

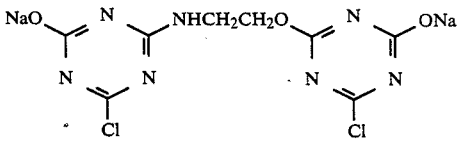
(II-6)

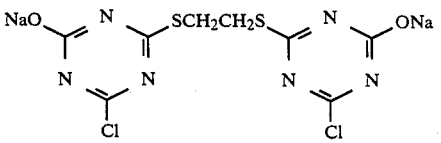
(II-7)

-continued

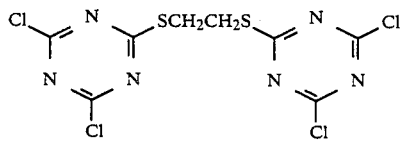

(II-8)

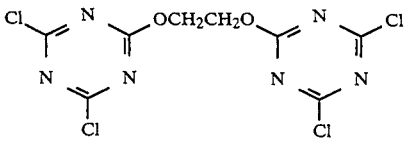

(II-9)

The compounds used in the invention each represented by the General Formula [I] or [II] may be used independently or in combination, and the amount thereof to be added is from 0.5 to 100 mg per g of gelating coated on a surface of the support on which the emulsion is coated and, more preferably, from 2 to 50 mg.

The above-mentioned compounds are to be added after they are dissolved in water or such an alcohol as methanol, ethanol and so forth.

Such compounds may be added in either a batch process or an in-line process.

The compounds each represented by the aforegiven General Formula [I] are described in, for example, U.S. Pat. No. 3,645,743, Japanese Patent Examined Publication Nos. 6151/1972, 33380/1972 and 9607/1976, Japanese Patent O.P.I. Publication Nos. 18220/1973, 78788/1976, 60612/1977, 128130/1977, 130326/1977 and 1043/1981, and so forth. Any one out of the above-mentioned compounds may be used in accordance with the above-given standards.

It was an amazing fact found in the invention that a silver halide emulsion layer was improved not only in the pressure resistance in a dry state but also in the pressure resistance in such a wet state as in a developing process by hardening a silver halide emulsion of the invention, that is, a silver halide emulsion containing silver halide grains having the above-mentioned silver chloride content of not less than 80 mol % and a water-soluble iridium compound in an amount of $10^{-8}$ to $10^{-5}$ mol per mol of a silver halide used, by making use of a compound relating to the invention represented by the General Formula [I] or [II].

The light-sensitive silver halide photographic materials each containing the above-mentioned silver halide emulsion of the invention (hereinafter referred to as a silver halide photographic light-sensitive material) may be in the form of, for example, a color negative or positive film, a color print paper or the like materials. The effects of the invention may effectively be displayed particularly in the case of applying the invention to a color print paper for direct appreciation of photographs.

The silver halide photographic light-sensitive materials including such color print papers may be of a monochromatic or multicolored type. In the case of the multicolored type, they are normally comprised of both of silver halide emulsion layers containing, respectively, magenta, cyan and yellow couplers to serve as the photographic couplers, and non-light-sensitive layers, both of which are coated in appropriate layer number and order over to the support of the light-sensitive material, so as to reproduce colors in a subtractive color process. Such layer number and order may suitably be changed according to the priority characteristics and the application purposes.

In the case that such a silver halide photographic light-sensitive material of the invention is of the multicolored type, the layer arrangement of the silver halide emulsion layers thereof may be freely selected, that is to say, the layer order of blue-light-sensitive, green-light-sensitive and red-light-sensitive emulsion layers may arbitrarily be arranged in any order. In the invention, besides the above, the non-light-sensitive layers other than a protective layer (such as an interlayer, a filter layer, an antiirradiation layer and so forth) may also arbitrarily be arranged, however, a preferable layer arrangement is that a yellow dye image forming layer, a 1st interlayer, a magenta dye image forming layer, a 2nd interlayer containing a UV absorbing agent, a cyan dye image forming layer, an interlayer containing a UV absorbing agent, and a protective layer are coated over to the support of a light-sensitive material, in an layer arrangement order from the support side.

The yellow dye forming couplers preferably useful in the invention include, for example, a well-known acylacetanilide type couplers. Among those couplers, benzoylacetanilide type and pivaloylacetanilide type compounds are advantageous for the invention.

The typical examples of the yellow couplers capable of being used include those described in British Pat. No. 1,077,847, Japanese Patent Examined Publication No. 40757/1970, Japanese Patent O.P.I. Publication Nos. 1031/1972, 26133/1972, 94432/1973, 87650/1975, 3631/1976, 115219/1977, 99433/1979, 133329/1979 and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752, and so forth.

The yellow couplers used in the invention are preferably represented by the following General Formula [Y].

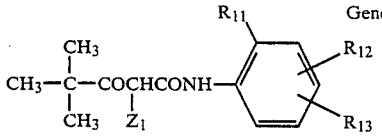

General Formula [Y]

[Wherein $R_{11}$ represents a halogen atom or an alkoxy group; $R_{12}$ represents a hydrogen atom, a halogen atom or an alkoxy group which is allowed to have a substituent; $R_{13}$ represents an acylamino group, an alkoxycarbonyl group, an alkylsulfamoyl group, an arylsulfamoyl group, an arylsulfonamido group, an alkylureido group, an arylureido group, a succinimido group, an alkoxy group or an aryloxy group each of which is allowed to have a substituent; and $Z_1$ represents a group capable of being splitted off upon coupling of the coupler to the oxidized product of a color developing agent.]

The magenta dye image forming couplers used in the invention are preferably represented by the following General Formulas [M-1] and [M-2].

General Formula [M-1]

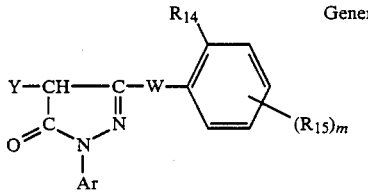

[Wherein Ar represents an aryl group; $R_{14}$ represents a hydrogen atom or a substituent; $R_{15}$ represents a substituent; Y represents a hydrogen atom or a substituent capable of being splitted off upon coupling the coupler to the oxidized product of a color developing agent; W represents an —NH—, an —NHCO—(in which the N atom is linked to the carbon atom of a pyrazolone nucleus) or an —NHCONH—; and m is an integer of 1 or 2.]

General Formula [M-2]

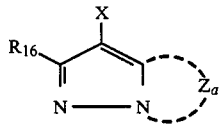

In the magenta couplers each represented by the General Formula [M-2], Za represents a group of non-metal atoms necessary for forming a nitrogen-containing heterocyclic ring in which the ring formed by the Za is allowed to have a substituent;

X represents a substituent capable of being splitted off upon coupling the coupler to the oxidized product of a color developing agent;

and $R_{16}$ represents a hydrogen atom or a substituent. The substituents each represented by the above-given $R_{16}$ include, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The above-mentioned substituents are described in, for example, U.S. Pat. Nos. 2,600,788, 3,061,432, 3,062,653, 3,127,269, 3,311,476, 3,152,896, 3,419,391, 3,519,429, 3,555,316, 3,684,514, 3,888,680, 3,907,571, 3,928,044, 3,930,861, 3,930,866 and 3,933,500; Japanese Patent O.P.I. Publication Nos. 29639/1974, 111631/1974, 129538/1974, 13041/1975, 58922/1977, 62453/1980, 118034/1980, 38043/1981, 35858/1982 and 23855/1985; British Pat. No. 1,247,493; Belgian Pat. Nos. 769,116 and 792,525; West German Pat. No. 2,156,111; Japanese Patent Examined Publication No. 60479/1971; Japanese Patent O.P.I. Publication Nos. 125732/1984, 228252/1984, 162548/1984, 171956/1984, 33552/1985 and 43659/1985; West German Pat. No. 1,070,030; and U.S. Pat. No. 3,725,067.

The cyan dye image forming couplers typically include, for example, phenol or naphthol 4-equivalent or 2-equivalent type cyan dye image forming couplers. They are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044; British Pat. Nos. 478,991, 945,542, 1,084,480, 1,377,233, 1,388,024 and 1,543,040; Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 117249/1985; and so forth.

As for the cyan image forming couplers, the couplers each represented by the following General Formulas [C-1] and [C-2]may preferably be used.

General Formula [C-1]

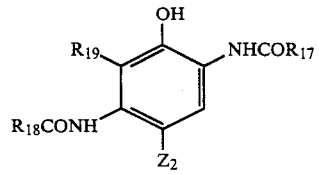

Wherein $R_{17}$ represents an aryl group, a cycloalkyl group or a heterocyclic group; $R_{18}$ represents an alkyl group or a phenyl group; $R_{19}$ represents a hydrogen atom, a halogen atom, an alkyl group or an alkoxy group; and $Z_2$ represents a hydrogen atom, a halogen atom or a group capable of being splitted off upon coupling the coupler to the oxidized product of the color developing agent.

General Formula [C-2]

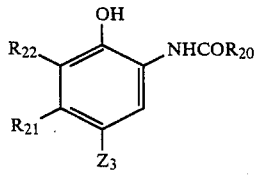

Wherein $R_{20}$ represents an alkyl group (such as a methyl group, an ethyl group, a propyl group, a butyl group, a nonyl group and so forth); $R_{21}$ represents an alkyl group (such as a methyl group, an ethyl group and so forth); $R_{22}$ represents a hydrogen atom, a halogen atom (such as a fluorine atom, a chlorine atom, a bromine atom and so forth) or an alkyl group (such as a methyl group, an ethyl group and so forth); and $Z_3$ represents a hydrogen atom, a halogen atom or a group capable of splitting off upon coupling the coupler to the oxidized products of the color developing agent.

A hydrophobic compounds such as dye forming couplers, which are not necessary to adsorb to the surfaces of silver halide crystals, may be added in various methods such as a solid dispersion method, a latex dispersion method, an oil drop-in-water type emulsification-dispersion method and so forth, which may suitably be selected according to the chemical structures of such a hydrophobic compound as couplers and so forth. The above-mentioned applicable oil drop-in-water type emulsification-dispersion method include a conventionally known process for dispersing such a hydrophobic compound as couplers and so forth. Such a hydrophobic compounds may be added into an objective hydrophilic colloidal layer in such a manner that the hydrophobic compound is dissolved in a high boiling organic solvent normally having a boiling point of not lower than about 150° C., in combination, if required, with a low boiling and/or water-soluble organic solvent, and the resulting solution is emulsified and dispersed into such a hydrophilic binders as an aqueous gelatin solution together with a surface active agent by making use of such a dispersing means as a stirrer, a homogenizer, a colloid mill, a flow mixer, an ultrasonic homogenizer and the like means, and the resulting emulsion is to be added to the objective hydrophilic colloidal layer. It is also allowed to apply a step of removing the low boiling organic solvent after or at the same time when the dispersion is completed.

As for the high boiling organic solvents, there uses, for example, an organic solvent having a boiling point of not lower than 150° C. which is incapable of reacting with the oxidized product of a developing agent, such as a phenol derivative, a phthalate, a phosphate, a citrate, a benzoate, an alkylamide, a fatty acid ester, a trimesic acid ester and so forth.

The high boiling organic solvents capable of being used in the invention are described in, for example, U.S. Pat. Nos. 2,322,027, 2,533,514, 2,835,579, 3,287,134, 2,353,262, 2,852,383, 3,554,755, 3,676,137, 3,676,142, 3,700,454, 3,748,141, 3,779,765 and 3,837,863; British Pat. Nos. 958,441 and 1,222,753; West German OLS Pat. No. 2,538,889; Japanese Patent O.P.I. Publication Nos. 1031/1972, 90523/1974, 23823/1975, 26037/1976, 27921/1976, 27922/1976, 26035/1976, 26036/1976, 62632/1975, 1520/1978, 1521/1978, 15127/1978, 119921/1979, 119922/1979, 25057/1980, 36869/1980, 19049/1981 and 81836/1981; Japanese Patent Examined Publication No. 29060/1973; and so forth.

The low boiling or water-soluble organic solvents which may be used together with or in place of the above-mentioned high boiling solvents include, for example, those described in U.S. Pat. Nos. 2,801,171 and 2,949,360, and so forth.

The low boiling and substantially water-insoluble organic solvents include, for example, ethyl acetate, propyl acetate, butyl acetate, butanol, chloroform, carbon tetrachloride, nitromethane, nitroethane, benzene and so forth. The water-soluble organic solvents include, for example, acetone, methyl isobutyl ketone, β-ethoxyethyl acetate, methoxyglycol acetate, methanol,, ethanol, acetonitrile, dioxane, dimethylformamide, dimethylsulfoxide, hexamethylphosphonylamide, diethylene glycol monophenyl ether, phenoxy ethanol and so forth.

The preferable latex dispersion processes include, for example, those described in U.S. Pat. Nos. 4,199,363, 4,214,047, 4,203,716 and 4,247,627; Japanese Patent O.P.I. Publication Nos. 74538/1974, 59942/1976, 59943/1976 and 32552/1979; and so forth.

The surface active agents to serve as a dispersion assistant preferably include, for example, anionic surface active agents such as an alkylbenzenesulfonate, an alkylnaphthalenesulfonate, an alkylsulfonate, an alkylsulfate, an alkylphosphate, a sulfosuccinate, a sulfoalkylpolyoxyethylenealkylphenyl ether and so forth; nonionic surface active agents such as a steroid type saponin, an alkyleneoxide derivative, a glycidol derivative and so forth; amphoteric surface active agents such as an amino acid, an aminoalkylsulfonate, an alkyl betaine and so forth; and cationic surface active agents such as a quaternary ammonium salt. The typical examples of the above-mentioned surface active agents are described in, for example, 'A Handbook of Surface Active Agents', published by Sangyo Tosho Publishing Co., 1966 and 'A Research of Emulsifiers and the Emulsifying Appratuses—The Technical Data thereof', published by Kagaku Hanron-Sha, 1978, respectively.

As for the binders used in the silver halide emulsions of the invention, gelatin is advantageously used and, besides, a hydrophilic colloid such as a gelatin derivative, a graft polymers of gelatin and other macromolecule, protein, a sugar derivative, a cellulose derivative, a synthesized hydrophilic macromolecular substance such as a monomer or a copolymer, and so forth.

For the purpose of improving the flexibility of the silver halide emulsion layers and/or the other hydrophilic colloidal layers of a light-sensitive material using the silver halide emulsions of the invention, a plasticizers may be added to.

For the purpose of improving the dimensional stability of the photographic emulsion layers and/or the other hydrophilic colloidal layers of a light-sensitive material using the silver halide emulsions of the invention, such layers are allowed to contain a water-insoluble or hardly soluble synthetic polymer dispersions (i.e., a latex).

For the purposes of preventing colors from staining, image-sharpness from deteriorating and graininess from being coarse when the oxidized products of a developing agent or electron transferring agents migrate between the emulsion layers (i.e., between the same color-sensitive layers and/or between the different color-sensitive layers) of the color photographic light-sensitive materials of the invention, a color fog inhibitor may be used.

Such color fog inhibitors may be used in an emulsion layer in itself or in an interlayer interposed between the emulsion layers each adjacent thereto.

In the color photographic light-sensitive materials each using the silver halide emulsions of the invention, an image stabilizer may also be used so as to prevent dye images from deteriorating.

In the silver halide photographic light-sensitive materials of the invention, the hydrophilic colloidal layers such as a protective layer, an interlayer and so forth are also allowed to contain a UV absorbing agent, with the purposes of preventing the light-sensitive material from being fogged by discharging a frictional electricity or the like, and preventing images quality from being deteriorated by UV rays.

It is also allowed to provide the color light-sensitive materials each using the silver halide emulsion of the invention with auxiliary layers-such as a filter layer, an antihalation layer, an antiirradiation layer and/or the like layers. These layers and/or the emulsion layers are allowed to contain such a dye as may be effused out from a color light-sensitive material, or may be bleached, in the course of developing the light-sensitive material.

In the silver halide light-sensitive materials each using the silver halide emulsions of the invention,, the silver halide emulsion layers and/or the other hydrophilic colloidal layers thereof are allowed to contain a matting agent for the purposes of reducing the gloss of the light-sensitive material, improving a retouchability, preventing adhesion to each other light-sensitive material ans so forth.

In the light-sensitive materials each using the silver halide emulsions of the invention, a lubricating agent may be added for the purpose of reducing the sliding friction of the light-sensitive materials.

In the light-sensitive materials each using the silver halide emulsions of the invention, an antistatic agent may be added for the purpose of preventing any static charge.

Such antistatic agents may sometimes be added in an antistatic layer provided onto the side of a support to which no emulsion is laminated, or they may also be added into the emulsion layers and/or the other protective colloidal layer than the emulsion layers arranged onto the side of the support to which the emulsion layers are laminated.

In the light-sensitive materials each using the silver halide emulsions of the invention, the photographic emulsion layers and/or the other hydrophilic colloidal layers may contain a variety of surface active agents, with the purposes of improving the coating property, an antistatic property, a slidability, an emulsification-dispersion property, an antiadhesion property, such a photographic characteristic as a development accelerating property, a hardening property, a sensitizing property, and so forth.

In the light-sensitive materials each using the silver halide emulsions of the invention, the photographic emulsion layers and the other layers thereof may be coated over to such a flexible reflection type support as a baryta paper, a paper laminated with α-olefin polymer or the like, a synthetic paper and so forth; such a semi-synthetic or synthetic polymer film as those of cellulose acetate, cellulose nitrate, a polystyrene, a polyvinyl chloride, a polyethyleneterephthalate, a polycarbonate, a polyamide, or the like; such a solid member as those made of a glass, a metal, an earthware or the like; and so forth.

The silver halide materials of the invention may be coated over to the surface of a support directly or through one or more subbing layers (which are provided for improving the surface of the support on adhesive property, static-preventive property, dimensional stability, antiabrasion property, hardness, antihalation property, abrasion property and/or other properties), after the surafce of the support is applied, if required, with such a treatment as a corona-discharge, a UV irradiation, a flame treatment and so forth.

In the process of coating the photographic light-sensitive material using the silver halide emulsions of the invention, a thickening agent may be used for improving the coatability. Among the coating processes, an extrusion coating process and a curtain coating process are particularly advatageous, because these processes are capable of coating two or more layers at the same time.

The light-sensitive materials of the invention may be exposed to light by making use of an electromagnetic wave in a spectral region to which the emulsion layers of the light-sensitive material of the invention is sensitive. The light sources capable of being used include, for example, any well-known light sources such as natural light (i.e., daylight), a tungsten lamp, a fluorescent lamp, a mercury lamp, a Xenon-arc lamp, a carbon-arc lamp, a Xenon-flash lamp, a cathode-ray tube flying-spot, a variety of laser beams, a light emission device, the rays of light emitted from a fluorescent substance excited by an electron beam, X rays, γ rays, α rays or the like rays, and so forth.

An exposure may be made not only for such an exposure time from 1 millisecond to 1 second as is generally applied by normal type cameras, but also for such an exposure time shorter than 1 microsecond as is made from 100 microseconds to 1 microsecond with the use of a cathode ray tube or a Xenon flash lamp and, in addition, an exposure time for not shorter than 1 second may also be made. Such an exposure as described above may be made either continuously or intermittently.

With the silver halide photographic light-sensitive materials of the invention, an image can be reproduced by carrying out a color developing process which has so far been well-known in the art.

In the invention, the color developing agents each capable of being used in a color developer include the well-known ones which have popularly been used in a variety of color photographic processes. The above-mentioned developing agents include, for example, an aminophenol derivative and a p-phenylenediamine derivative. The above-mentioned compounds are generally used in the form of such a salt as a chloride or sulfate, because these compounds are more stable than in a free state. These compounds are to be used generally in a concentration of from about 0.1 g to about 30 g per liter of a color developer and, more preferably, from about 1 g to about 15 g per liter of a color developer.

Such an aminophenol type developing agents include, for example, o-aminophenol, p-aminophenol, 5-amino-2-oxytoluene, 2-amino-3-oxytoluene, 2-oxy-3-amino-1,4-dimethylbenzene and so forth.

The particularly useful aromatic primary amine type color developing agent is an N,N'-dialkyl-p-phenylenediamine type compound and the alkyl group and phenyl group thereof may be substituted with any substituents. Among them, the particularly useful compounds include, for example, an N,N'-diethyl-p-phenylenediamine chloride, an N-methyl-p-phenylenediamine chloride, an N,N'-dimethyl-p-phenylenediamine chloride, a 2-amino-5-(N-ethyl-N-dodecylamino)-toluene, an N-ethyl-N-β-methanesulfonamidoethyl-3-methyl-4-aminoaniline sulfate, an N-ethyl-N-β-hydroxyethylaminoaniline, a 4-amino-3-methyl-N,N'-diethylaniline, a 4-amino-N-(2-methoxyethyl)-N-ethyl-3-methylaniline-p-toluene sulfonate and so forth.

In processing the silver halide photographic light-sensitive materials of the invention, the color developers applicable thereto may be added with a compound having already been known as a component of a developer, as well as with the above-mentioned aromatic primary amine type color developing agents.

For example, such an alkalizer as sodium hydroxide, sodium carbonate, potassium carbonate and so forth, an alkali metal sulfite, an alkalimetal bysulfite, an alkali metal thiocyanate, an alkali metal halide, benzyl alcohol, a water softener, a thickening agent and so forth may arbitrarily be contained in the above-mentioned color developers.

A pH value of the above-mentioned color developers is normally not lower than 7 and, most generally, from about 10 to about 13.

The silver halide photographic light-sensitive materials of the invention is satisfactorily processed in the so-called rapid processes each capable of processing light-sensitive materials at a relatively high temperature and in a relatively short period of time. Such a color development is made at a temperature of not lower than 25° C. and, more preferably, within the range of from not lower than 30° C. to not higher than 45° C. A developing time is preferably within the range of from not shorter than 40 seconds to not longer than 120 second.

The silver halide photographic light-sensitive materials relating to the invention may contain the above-mentioned color developing agents as they are or as their precursors in the hydrophilic colloidal layers of the light-sensitive materials and, such light-sensitive materials may also be processed in an alkaline activation bath. Such color developing agent precursors are the compounds each capable of producing a color developing agent under an alkaline condition, and they include, for example, a Schiff base type precursor prepared with an aromatic aldehyde derivative, a polyvalent metal ion complex precursor, a phthalimide derivative precursor, a phosphorous amide derivative precursor, a sugar amine reactant precursor, and a urethane type precursor. The above-mentioned precursors of aromatic primary amine color developing agents are described in, for example, U.S. Pat. Nos. 3,342,599, 2,507,114, 2,695,234 and 3,719,492; British Pat. No. 803,783; Japanese Patent O.P.I. Publication Nos. 185628/1978 and 79035/1979; and Research Disclosure Nos. 15159, 12146 and 13924.

The above-mentioned aromatic primary amine color developing agents or the precursors thereof are necessarily be added in such an adequate amount as is capable of obtaining a satisfactory color reproduction when an activation process is carried out. Such an amount added thereof depends considerably upon the kinds of the light-sensitive materials to be prepared, however, the amount added thereof is roughly in the range between 0.1 mol and 5 mol per mol of a silver halide used and, more preferably, between 0.5 mol and 3 mol. The above-mentioned color developing agents or the precursors thereof may be used independently or in combination.

These color developing agents or the precursors thereof may be incorporated into light-sensitive materials by dissolving them into water or an appropriate solvent such as methanol, ethanol, acetone or the like, and they may also be added therein in the form of an emulsification-dispersion solution by making use of a high boiling organic solvent such as dibutyl phthalate, dioctyl phthalater, tricresyl phthalate or the like solvents, and they may further be added therein by impregnating them into a latex polymer as described in, for example, Research Disclosure, No. 14850.

The silver halide photographic light-sensitive materials of the invention may be bleached and fixed after being color-developed. Such a bleaching and fixing treatments may be made at the same time.

Such bleaching agents to be used therein include a variety of compounds which include polyvalent metal compounds such as iron (III), cobalt (III), copper (II) and so forth and, particularly, the complex salts of the cations of the above-mentioned polyvalent metal compounds and organic acids including, for example, an aminopolycarboxylic acid such as ethylenediaminetetraacetic acid, nitrilotriacetic acid and N-hydroxyethyl ethylenedimaninediacetic acid; the metal salts including, for example, those of malonic acid, tartaric acid, malic acid, diglycolic acid, dithioglycolic acid and so forth; a ferricyanide; a dichromate; and so forth. These compounds may be used independently or in combination.

The above-mentioned bleach-fixer is used at a pH value of not less than 4.0, normally within the range of from not lower than pH 5.0 to not higher than 9.5, preferably, from not lower than pH 6.0 to not higher than pH 8.5 and, most preferably, from not lower than pH 6.5 to not higher than 8.5. A temperature of such processing is preferably within the range of from not lower than 80° C. to not higher than 55° C. or lower so as to inhibit an evaporation and so forth.

A color light-sensitive material already color- developed and bleach-fixed is necessarily washed so as to remove unnecessary chemicals. It is, however, allowed to replace the washing step by the so-called washless stabilization step such as those described in Japanese Patent O.P.I. Publication Nos. 14834/1983, 105145/1983 and 134634/1983, Japanese Patent Application Nos. 2709/1983 and 89288/1984, and so forth.

In the case of processing a color light-sensitive material while continuously replenishing each of the color developer, bleach-fixer and stabilizer of the invention, a suitable ratio of replenishing each replenisher is from 100 to 1000 ml per sq. meter of the color light-sensitive material and, more preferably, from 150 to 500 ml.

As for the fixers, a soluble complex-forming agent capable of dissolving a silver halide to be a complex salt may be used. Such soluble complex-forming agents include, for example, sodium thiosulfate, ammonium thiosulfate, potassium thiocyanate, thiourea, thioether and so forth.

The silver halide photographic light-sensitive materials of the invention are fixed and are then normally washed. Such a washing treatment may be replaced by a stabilizing treatment, and both of washing and stabilizing treatments may also be applied in combination. In a stabilizing treatment, the stabilizers used therein may contain a pH controller, a chelating agent, an antimold and so forth. The concrete requirements for the above-mentioned treatments may be referred to Japanese Patent O.P.I. Publication No. 134636/1983 and so forth.

According to the invention, as described above, it is possible to provide a silver halide photographic light-sensitive materials each excellent in antipressure effect in both of dry and wet states and suitable for a rapid processing as well as to provide the preparation process thereof.

EXAMPLES

The typical examples of the invention will now be described below. It is, however, to be understood that any and all embodiments of the invention shall not be limited thereto.

EXAMPLE 1

A silver chloride emulsion was prepared in such a manner that an aqueous solution of potassium chloride and an aqueous solution of silver nitrate were mixed up at the same time into an aqueous solution of inertized gelatin containing potassium chloride, at 50° C. for 60 minutes, with violently stirring. In the mixing step, the pAg value was controlled to be 7.

The characteristics of the resulted silver chloride emulsion was measured in the aforementioned method. The results thereof were proved to be the cubic silver chloride grains each having an average grain size of 0.8 μm, and a variation coefficient of 0.10. When a maximum density ratio (i.e., a ratio of an internal development to a surface development) was measured in the aforementioned method, it was 1.2.

The resulted silver chloride grains were added with sodium thiosulfate and were then chemically sensitized. At the point of time when the chemical sensitization was completed, the chemically sensitized grains were added with a blue light-sensitive spectral sensitizers and a stabilizers, so that a blue light-sensitive silver chloride emulsion (hereinafter called Emulsion A) was prepared.

Next, a cubic silver chloride emulsion having an average grain size of 0.8 μm, a variation coefficient of 0.1 and a maximum density ratio of 1.3 was prepared in the same manner, except that $K_2IrCl_6$ was added in an amount of $2\times10^{-6}$ mol per mol of the silver halide used 30 minutes after the start of adding an aqueous solution of potassium chloride and silver nitrate. Further, a blue light-sensitive silver chloride emulsion (hereinafter called Emulsion B) was prepared in the same manner as in the preparation of Emulsion A.

Next, a cubic silver bromide emulsion having an average grain size of 0.8 μm, a variation coefficient of 0.11 and a maximum density ratio of 1.0 was prepared in such a manner that an aqueous solution of potassium bromide and an aqueous solution of silver nitrate were mixed up at the same time into an aqueous solution of inertized gelatin at 70° C. for 120 minutes, with controlling a pAg value to keep at 5.5 and with violently stirring. Further, a blue light-sensitive silver bromide emulsion (hereinafter called Emulsion C) was prepared in the same manner as in the preparation of Emulsion A.

A blue light-sensitive cubic silver bromide emulsion (hereinafter called Emulsion D) having an average grain size of 0.8 μm, a variation coefficient of 0.11 and a maximum density ratio of 1.2 was prepared in the same manner, except that $K_2IrCl_4$ was added in an amount of $2\times10^{-6}$ mol per mol of the silver halide used 60 minutes after the start of adding an aqueous solution of potassium bromide and silver nitrate.

On the other hand, 80 g of yellow couplers were dissolved in a mixed solution of 30 g of dinonyl phthalate to serve as a high boiling organic solvent and 100 ml of ethyl acetate to serve as a low boiling organic solvent and were then added with 300 ml of an aqueous solution of 5% gelatin containing sodium dodecylbenzenesulfonate. The resulted solution was dispersed by means of a ultrasonic homogenizer, so that a yellow coupler dispersion solution was prepared.

Next, the following two layers were coated over to a polyethylene-laminated support in order from the support side, so that a silver halide photographic light-sensitive material was prepared, provided, however, that the following amounts added are expressed in the amounts added per sq. meter, unless otherwise specially stated.

Layer-1

A layer containing 2.0 g of gelatin, 0.3 g (in terms of silver content) of a blue light-sensitive silver halide emulsion*, 0.8 g of yellow couplers, 0.3 g of dinonyl phthalate and the hardener of the invention* or the comparative hardener (H-1)*.

* Shown in Table-1 below.

Layer-2

A layer containing 1.5 g of gelatin and the hardener of the invention or the comparative hardener (H-1).

Comparative Hardener (H-1)

$CH_3C(CH_2OCH_2SO_2CH{=}CH_2)_3$

Yellow Coupler

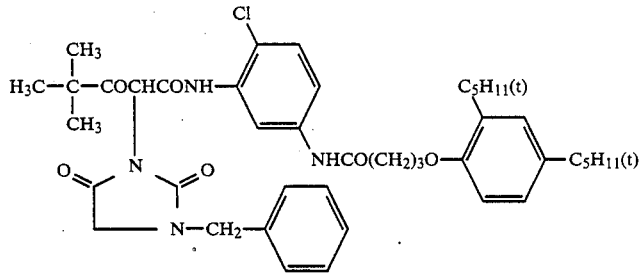

The above-mentioned coated sample was used after having preserved at 35° C. and 50%RH for 2 days.

The pressure resistance property was evaluated in the following manner:

[Antipressure effect in a dry state]

A ball-point needle having a diameter of 0.1 mm was stood vertically on the surface of a sample and was then applied with a load at the same time when the sample surface is kept moving horizontally at a rate of 1 cm per second.

Thereafter, each sample was exposed to white light by making use of a photosensitometer (Model KS-7 manufactured by Konishiroku Photo Ind. Co., Ltd.) and was then processed in according to the processing steps given below. Then, the color densities were measure by a Sakura Microdensitometer (Model PDM-5) with respect to the areas in the vicinity of the color density of about 0.3, one area applied with a pressure and the other area not applied with any pressure. The results thereof were evaluated as follows. In the evaluation results, it was found that the smaller a $\Delta D^d$ value is, the more excellent an antipressure effect is.

$\Delta D^d$=(Density in a non-pressure area)−(Density in a pressure area)

[Antipressure effect in a wet state]

Each of the samples was stepwise exposed to light in the same manner as described above and was dipped in pure water at 30° C. for 3 minutes. After then, a ball-point needle having a ball diameter of 0.3 mm was stood vertically on the surface of the wet sample and was then applied continuously with a load at the same time when the sample surface is kept moving horizontally at a rate of 1 cm per second.

Thereafter, each sample was processed according to the processing steps given below. Then, the color densities were measure by a Sakura Microdensitometer (Model PDM-5) with respect to the areas in the vicinity of the color density of about 0.3, one area applied with a pressure and the other area not applied with any pressure. The results thereof were evaluated as follows. In the evaluation results, it was found that the smaller a $\Delta D^w$ value is, the more excellent an antipressure effect is.

$\Delta D^w$=(Density in a non-pressure area)−(Density in a pressure area)

The results thereof are shown in Table-1.

| [Processing steps] | Temperature | Time |
|---|---|---|
| Color developing | 34.7 ± 0.3° C. | 50 sec. |
| Bleach-fixing | 34.7 ± 0.5° C. | 50 sec. |
| Stabilizing | 30 to 34° C. | 90 sec. |
| Drying | 60 to 80° C. | 60 sec. |

| [Color developer] | |
|---|---|
| Pure water | 800 ml |
| Ethyleneglycol | 10 ml |
| N,N—diethylhydroxylamine | 10 ml |
| Potassium chloride | 2 g |
| N—ethyl-N—β-methanesulfonamidethyl-3-methyl-4-aminoanilinesulfate | 5 g |
| Sodium tetrapolyphosphate | 2 g |
| Potassium carbonate | 30 g |
| Optical brightening agent, (A 4,4'-diaminostilbene disulfonic acid derivative) | 1 g |
| Water to be added to make in total | 1 liter |
| pH to be adjusted with potassium carbonate or glacial acetic acid to | pH 10.08 |
| [Bleach-fixer] | |
| Ferric ammonium ethylenediaminetera-acetate dihydrate | 60 g |
| Ethylenediaminetetraacetic acid | 3 g |
| Ammonium thiosulfate (A 70% solution) | 100 ml |
| Ammonium sulfite (A 40% solution) | 27.5 ml |
| pH to be adjusted with potassium carbonate or glacial acetic acid to | pH 7.1 |
| Water to be added to make in total | 1 liter |
| [Stabilizer] | |
| 5-chloro-2-methyl-4-isothiazoline-3-one | 1 g |
| 1-hydroxyethilidene-1,1-diphosphoric acid | 2 g |
| Water to be added to make | 1 liter |
| pH to be adjusted with sulfuric acid or potassium hydroxide to | pH 7.0 |

TABLE 1

| Sample No. | Emul-sion | $K_2IrCl$ (mol/mol AgX) | Hardener (mg/g of gelatin) | Antipressure effect In dry $\Delta D^D$ | Antipressure effect In wet $\Delta D^w$ |
|---|---|---|---|---|---|
| 1 | A | — | I-2 (7) | 0.03 | 0.39 |
| 2 | A | — | H-1 (14) | 0.35 | 0.41 |
| 3 (This invention) | B | $2 \times 10^{-6}$ | I-2 (7) | 0.04 | 0.05 |
| 4 | B | $2 \times 10^{-6}$ | H-1 (14) | 0.28 | 0.38 |
| 5 | C | — | I-2 (7) | 0.10 | 0.09 |
| 6 | C | — | H-1 (14) | 0.10 | 0.09 |
| 7 | D | $2 \times 10^{-6}$ | I-2 (7) | 0.08 | 0.09 |
| 8 | D | $2 \times 10^{-6}$ | H-1 (14) | 0.07 | 0.08 |

The following facts are obvious from the Table-1. Namely, it is found from the samples 1 and 5, 2 and 6, and 4 and 8 that silver chloride emulsions are remarkably inferior to silver bromide emulsions in antipressure effect. It is also found from the samples 1, 2 and 4 that the pressure effects thereof have not almost been displayed when the silver chloride of the samples were added with an iridium compound or the hardening agent of the invention, independently. On the other hand, it is found from the sample 3 having the composition of the invention that the antipressure effects thereof are remarkably improved so as to achieve the objects of the invention.

In the case of using silver bromide, it ia found from the samples 5, 6, 7 and 8 that any antipressure effect may not be improved because they have no constitution of the invention and that the improvement of antipressure effects is one of the peculiar advantages of the invention.

Further the samples 3 and 7 were exposed to light and processes respectively in the same manner as in the evaluation of antipressure effect, provided that the color developing times were vairied to be 30, 50, 90 and 210 seconds, respectively.

With each of the resulted samples, the sensitivity and maximum density were measured by means of an optical densitometer, Model PDA-60 (manufactured by Konishiroku Photo Ind. Co., Ltd.). The results thereof are shown in Table-2 below.

TABLE 2

| Sample No. | | Color Developing Time 30" | 50" | 90" | 210" |
|---|---|---|---|---|---|
| 3 (Invention) | Relative speed | 95 | 100 | 102 | 103 |
| | Max. density | 2.48 | 2.51 | 2.52 | 2.53 |
| 7 (Comparative) | Relative speed | 25 | 35 | 39 | 50 |
| | Max. density | 0.42 | 0.51 | 0.61 | 1.15 |

It is found from Table-2 that the sample 3 using a silver chloride emulsion took a time for 30 to 50 seconds to reach its approximate maximum speed and maximum density and, in contrast to the above, the sample 7 using a silver bromide emulsion substantially delayed in development progression to reach its maximum speed and density which are only about a half of those of the above-mentioned silver chloride emulsion.

The samples 1, 2, 4, 5, 6 and 8 were also tested in the same manner and the similar results were obtained.

EXAMPLE 2

There prepared a blue light-sensitive cubic silver chlorobromide emulsion (hereinafter called Emulsion E), which contains silver bromide in an amount of 5 mol % and has an average grain size of 0.8 μm, a variation coefficient of 0.1 and a maximum density ratio of 1.3, in the same manner as in the preparation of Emulsion B of Example 1.

Similarly, a blue light-sensitive silver chlorobromide emulsion (hereinafter called Emulsion F), which contains silver bromide in an amount of 15 mol % and has an average grain size of 0.8 μm, a variation coefficient of 0.1 and a maximum density ratio of 1.3.

Further, the same yellow coupler dispersion liquid as was applied to Example 1 was similarly coated so as to prepare the samples. The contents of the samples are shown in Table-3 below. The resulted samples were evaluated on the antipressure effect thereof in the same manner as in Example 1. The results thereof are shown in the Table-3.

TABLE 3

| Sample No. | Emul-sion | $K_2IrCl$ (mol/mol AgX) | Hardener (mg/g of gelatin) | Antipressure effect In dry $\Delta D^D$ | Antipressure effect In wet $\Delta D^w$ |
|---|---|---|---|---|---|
| 11 (This invention) | B | $2 \times 10^{-6}$ | I-1 (7) | 0.04 | 0.06 |
| 12 (This invention) | B | $2 \times 10^{-6}$ | I-5 (7) | 0.05 | 0.05 |
| 13 (This invention) | B | $2 \times 10^{-6}$ | II-2 (14) | 0.05 | 0.06 |
| 14 (This invention) | B | $2 \times 10^{-6}$ | II-6 (14) | 0.04 | 0.06 |

TABLE 3-continued

| Sample No. | Emulsion | $K_2IrCl$ (mol/mol AgX) | Hardener (mg/g of gelatin) | Antipressure effect In dry $\Delta D^D$ | Antipressure effect In wet $\Delta D^W$ |
|---|---|---|---|---|---|
| 15 (This invention) | B | $2 \times 10^{-6}$ | I-2 (7) | 0.02 | 0.02 |
| 16 (This invention) | E | $2 \times 10^{-6}$ | I-2 (7) | 0.04 | 0.05 |
| 17 (This invention) | F | $2 \times 10^{-6}$ | I-2 (7) | 0.05 | 0.06 |

To the sample 15, a mercapto compound denoted by A-14 was added in an amount of 30 mg per mol of a silver halide used.

It is found from the Table-3 that the samples are capable of displaying an excellent antipressure effect as same as in Example 1, even if varying the kinds of the hardening agents of the invention and the silver chloride contents of the emulsions within the range allowable by the invention. Among them, the sample 15 containing the mercapto compound denoted by A-14 displays a particularly excellent antipressure effect.

In addition to the above samples, the samples 14, 15 and 16 were color-developed by varying the developing time, respectively and the results thereof are shown in Table-4.

TABLE 4

| Sample No. | | Color Developing Time 30" | 50" | 90" | 210" |
|---|---|---|---|---|---|
| 15 | Relative speed | 94 | 100 | 101 | 101 |
| (Invention) | Max. density | 2.47 | 2.49 | 2.50 | 2.51 |
| 16 | Relative speed | 95 | 99 | 100 | 101 |
| (Invention) | Max. density | 2.46 | 2.48 | 2.50 | 2.51 |
| 17 | Relative speed | 95 | 99 | 100 | 101 |
| (Invention) | Max. density | 2.40 | 2.45 | 2.51 | 2.50 |

It is found from the Table-4 that the samples of the invention can display an excellent rapid processability, even if varying the silver chloride contents within the range specified in the invention.

In addition, the same results were obtained from the samples 11 through 14, respectively.

EXAMPLE 3

The multilayered samples were prepared in accordance with the compositions shown in Tables-5, 6-1 and 6- 2, respectively.

The resulted samples were evaluated on the antipressure effects thereof in the same manner as in Example 1, provided that the exposures were made separately to blue, green and red rays of light and the desities in cyan, magenta and yellow where denoted by $D_R$, $D_G$ and $D_B$, respectively. The results obtained are shown in Table-7. Further, the samples were also evaluated by varying the color developing time as same as in Example 1. The results thereof are shown in Table-8.

TABLE 5

| Layer | Composition |
|---|---|
| 7th layer (Protective layer) | Gelatin (1.0 g/m$^2$) |
| 6th layer | Gelatin (1.0 g/m$^2$) |

TABLE 5-continued

| Layer | Composition |
|---|---|
| (3rd interlayer) | UV absorbing agent UV-1 (0.2 g/m$^2$) UV-2 (0.1 g/m$^2$) |
| | Antistaining agent AS-1 (0.02 g/m$^2$) |
| | High boiling solvent, Dinonyl phthalate (0.2 g/m$^2$) |
| 5th layer (Red-sensitive) | Gelatin (1.2 g/m$^2$) |
| | Red-sensitive silver halide emulsion (0.25 g/m$^2$ in terms of silver used) |
| | Cyan coupler* |
| | Antistaining agent AS-1 (0.01 g/m$^2$) |
| | High boiling solvent, Dioctyl phthalate (0.2 g/m$^2$) |
| 4th layer (2nd interlayer) | Gelatin (1.5 g/m$^2$) |
| | UV absorbing agent UV-1 (0.5 g/m$^2$) UV-2 (0.2 g/m$^2$) |
| | Antistaining agent AS-1 (0.03 g/m$^2$) |
| | High boiling solvent, Dinonyl phthalate (0.3 g/m$^2$) |
| 3rd layer (Green-sensitive) | Gelatin (1.5 g/m$^2$) |
| | Green-sensitive silver halide emulsion (0.2 g/m$^2$ in terms of silver used) |
| | Magenta coupler* (0.4 g/m$^2$) |
| | Antistaining agent AS-1 (0.01 g/m$^2$) |
| | High boiling solvent* (0.25 g/m$^2$) |
| 2nd layer (1st interlayer) | Gelatin (1.0 g/m$^2$) |
| | Antistaining agent AS-1 (0.07 g/m$^2$) |
| | High boiling solvent, Diisodecyl phthalate (0.04 g/m$^2$) |
| 1st layer (Blue-sensitive) | Gelatin (2.0 g/m$^2$) |
| | Blue-sensitive silver halide emulsion (0.3 g/m$^2$ in terms of silver used) |
| | Yellow coupler* (0.8 g/m$^2$) |
| | Antistaining agent AS-1 (0.02 g/m$^2$) |
| | High boiling solvent, Dinonyl phthalate (0.3 g/m$^2$) |
| Support | Polyethylene-coated paper |

Parentheses: An amount coated or added is given therein.
Asterisks: See Table 6.

TABLE 6-1

| Sample No. | | Blue sensitive layer | Green sensitive layer | Red sensitive layer |
|---|---|---|---|---|
| 21 | Coupler | Y-2 | M-1 | C-1 |
| | Emulsion | AgC 0.98 Br 0.02 | AgC 0.98 Br 0.02 | AgC 0.98 Br 0.02 |
| | Amt. of $K_2IrCl_6$ (mol/mol AgX) | $2 \times 10^{-6}$ | $5 \times 10^{-6}$ | $5 \times 10^{-6}$ |
| | Hardener (mg/g of gelatin) | I-2 (7) | I-2 (7) | I-2 (7) |

TABLE 6-2

| | |
|---|---|
| Sample No. 22: | The same as Sample No. 21 except that the coupler in the green-sensitive layer was replaced by M-2 and the coating amount of the green sensitive emulsion is increased to 0.4 g/m$^2$. |
| Sample No. 23: | The same as Sample No. 21 except that $K_2IrCl_6$ was not yet added into each layer and the hardener in each layer was replaced by H-1 in an amount of 14 mg/g of gelatin used. |
| Sample No. 24: | The same as Sample No. 21 except that the silver contained in the emulsion of each layers was replaced by silver bromide. |

To each of the layers of every sample, the compound denoted by A-12 was added in an amount of 30 mg per mol of the silver halide used.

The structures of the compounds indicated in Tables 6-1 and 6-2 will be given below:

Yellow Coupler (Y-2)

-continued
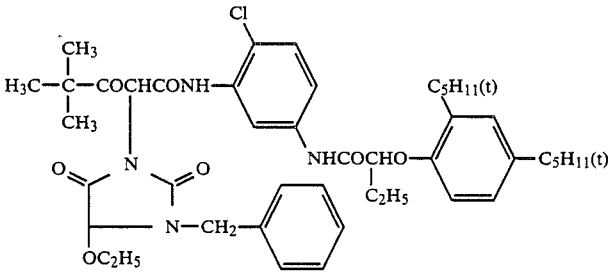
Magenta Coupler (M-1)
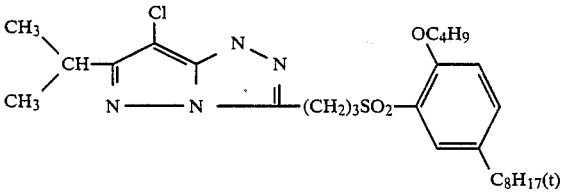
Magenta Coupler (M-2)
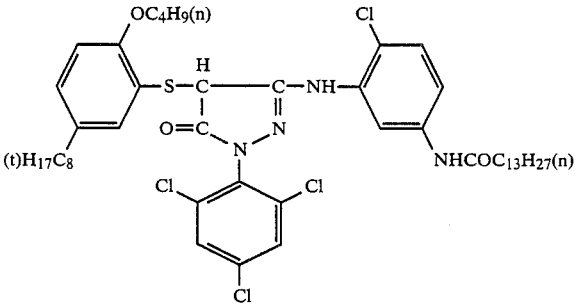
Cyan Coupler (C-1)
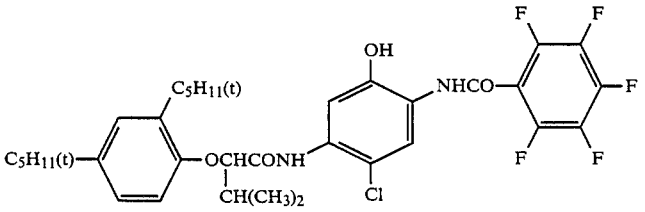
UV Absorbing Agent (UV-1)
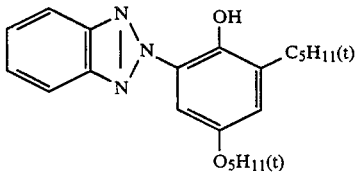
Absorbing Agent (UV-2)
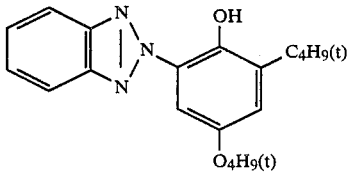
Antistaining Agent (AS-1)

-continued

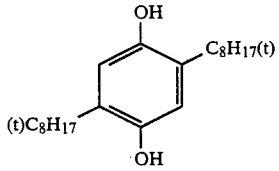

TABLE 7

| Sample No. | In dry state $\Delta D_B^D$ | $\Delta D_G^D$ | $\Delta D_R^D$ | In wet state $\Delta D_B^W$ | $\Delta D_G^W$ | $\Delta D_R^W$ |
|---|---|---|---|---|---|---|
| 21 (Invention) | 0.02 | 0.03 | 0.02 | 0.03 | 0.04 | 0.04 |
| 22 (Invention) | 0.03 | 0.02 | 0.02 | 0.03 | 0.03 | 0.04 |
| 23 (Comparative) | 0.33 | 0.35 | 0.32 | 0.41 | 0.42 | 0.40 |
| 24 (Comparative) | 0.05 | 0.04 | 0.05 | 0.06 | 0.06 | 0.07 |

TABLE 8

| | Color developing time 30 sec. | 50 sec. | 90 sec. | 210 sec. |
|---|---|---|---|---|
| Sample No. 21: (Invention) | | | | |
| Blue-sensitive layer | | | | |
| Relative sensitivity | 95 | 98 | 100 | 101 |
| Max. density | 2.40 | 2.45 | 2.48 | 2.51 |
| Green-sensitive layer | | | | |
| Relative sensitivity | 97 | 100 | 101 | 100 |
| Max. density | 2.48 | 2.51 | 2.50 | 2.51 |
| Red-sensitive layer | | | | |
| Relative sensitivity | 98 | 100 | 101 | 101 |
| Max. density | 2.48 | 2.53 | 2.54 | 2.54 |
| Sample No. 24: (Comparative) | | | | |
| Blue-sensitive layer | | | | |
| Relative sensitivity | 22 | 32 | 45 | 65 |
| Max. density | 0.40 | 0.53 | 0.70 | 1.10 |
| Green-sensitive layer | | | | |
| Relative sensitivity | 34 | 45 | 67 | 83 |
| Max. density | 0.92 | 1.15 | 1.65 | 2.02 |
| Red-sensitive layer | | | | |
| Relative sensitivity | 40 | 55 | 75 | 97 |
| Max. density | 1.32 | 1.50 | 1.75 | 2.31 |

As is obvious from Table-7, it is found that the samples 21 and 22 each having the constitution of the invention are capable of displaying an excellent antipressure effect as same as in the aforegoing Examples 1 and 2, even when they are multilayered. It is also found that the mercapto compounds, which are preferably used in the invention, bring in the advantageous effects only when they are added to the compositions of the silver halide light-sensitive materials of the invention.

Further, it is found from the above-given Table-8 that the substantial chloride-containing silver halide emulsions of the invention can display a remarkably faster color developability than in any silver bromide emulsion, even when they are multilayered.

As described above, according to the constitution of the invention, a rapid processable silver halide light-sensitive material can be so privided as to be excellent in antipressure effect in both dry and wet states, thast is the object of the invention.

What is claimed is:

1. A silver halide photographic light-sensitive material comprising a support bearing thereon at least one silver halide emulsion layer, wherein said silver halide emulsion layer comprises silver halide grains comprising not less than 80 mol % of silver chloride and a water soluble iridium compound in an amount of from $10^{-8}$ to $10^{-5}$ mol per mol of a silver halide contained in said silver halide emulsion layer, and said silver halide emulsion layer is hardened with at least one selected from the group consisting of the compounds each represented by the following General Formula [I] and the compounds each represented by the following General formula [II]:

General Formula [I]

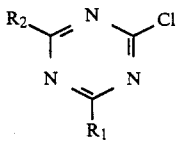

wherein $R_1$ is a chlorine atom, a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or a aryl group; and $R_2$ is a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, is which R is a hydrogen atom, an alkyl group or an aryl group, General Formula [II]

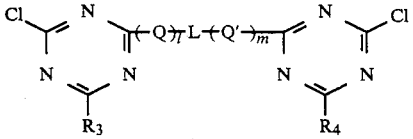

wherein $R_3$ and $R_4$ are each a chlorine atom, a hydroxy group, an alkyl group, an alkoxy group or —OM group; in which M is a monovalent metal atom; Q and Q' are each an —O—, an —S—or an —NH— group; L is an alkylene group or an arylene group; and l and m are each 0 or 1.

2. The silver halide photographic light-sensitive material of claim 1, wherein an amount of said compound selected from the group consisting of compounds each represented by General Formula [I] and [II] is within the range of from 0.5 to 100 mg per 1 g of gelatin beared on a surface of said support on which said silver halide emulsion layer is provided.

3. The silver halide photographic light-sensitive material of claim 2, wherein an amount of said compound selected from the group consisting of compounds each represented by General Formula [I] and [II] is within the range of from 2 to 50 mg per 1 g of gelatin beared on a surface of said support on which said silver halide emulsion layer is provided.

4. The silver halide photographic light-sensitive material of claim 1, wherein in a silver halide emulsion of said silver halide emulsion layer, the ratio of the maximum density obtained by internal developing said silver halide emulsion to the maximum density obtained by surface developing the same is not more than 5.

5. The silver halide photographic light-sensitive material of claim 4, wherein a silver halide emulsion of said silver halide emulsion layer, the ratio of the maximum density obtained by internal developing said silver halide emulsion to the maximum density obtained by surface developing the same is not more than 2.

6. A silver halide photographic light-sensitive material comprising a support bearing thereon at least one silver halide emulsion layer, wherein said silver halide emulsion layer comprises silver halide grains comprising not less than 80 mol % of silver chloride, a water soluble iridium compound in an amount of from $10^{-8}$ to $10^{-5}$ mol per mol of a silver halide contained in said silver halide emulsion layer and a hetrocyclic compound having a mercapto group, and said silver halide emulsion layer is hardened with at least one selected from the group consisting of the compounds each represented by the following General Formula [I] and the compounds each represented by the following General formula [II];

General Formula [I]

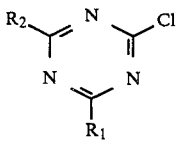

wherein $R_1$ is a chlorine atom, a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or aryl group; and $R_2$ is a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or an aryl group.

General Formula [II]

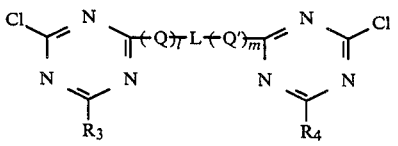

wherein $R_3$ and $R_4$ are each a chlorine atom, a hydroxy group, an alkyl group, an alkoxy group or —OM group; in which M is a monovalent metal atom; Q and Q' are each an —O—, an —S— or an —NH— group; L is an alkylene group or an arylene group; and l and m are each 0 or 1.

7. The silver halide photographic light-sensitive material of claim 6, wherein an amount of said compound selected from the group consisting of compounds each represented by General Formula [I] and [II] is within the range of from 0.5 to 100 mg per 1 g of gelatin beared on a surface of said support on which said silver halide emulsion layer is provided.

8. The silver halide photographic light-sensitive material of claim 7, wherein an amount of said compound selected from the group consisting of compounds each represented by General Formula [I] and [II] is within the range of from 2 to 50 mg per 1 g of gelatin beared on a surface of said support on which said silver halide emulsion layer is provided.

9. The silver halide photographic light-sensitive material of claim 6, wherein said heterocyclic compound havin a mercapto group is represented by the following General Formula [A-a]:

General Formula [A-a]

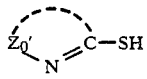

wherein $Z_0'$ is a group of atoms necessary for completing an imidazoline ring, an imidazolone ring a pyrazoline ring, a pyrazole ring, a pyrazolone ring, an oxazoline ring, an oxazole ring, an oxazolone ring, a thiazoline ring, a thiazole ring, a thiazolone ring, a selenazoline ring, a selenazole ring, a selenazolone ring, an oxadiazole ring, a thiadiazole ring, a triazole ring, a tetrazole ring, a benzimidazole ring, a benztriazole ring, an indazole ring, a benaoxazole ring, a benzthiazole ring, a benzselenazole ring, a pyridine ring, a pyrimidine ring, a pyridazine ring, a triazine ring, an oxazine ring, a thiazine ring, a tetrazine ring, a quinazoline ring, a phthalazine ring or a polyazaindene ring, which are allowed to have a substitute selected from an alkyl group, an alkenyl group a sulfamoyl group a carbamoyl group and an acyl group.

10. The silver halide photographic light-sensitive material of claim 6, wherein in a silver halide emulsion of said silver halide emulsion layer, the ratio of the maximum density obtained by internal developing said silver halide emulsion to the maximum density obtained by surface developing the same is not more than 5.

11. The silver halide photographic light-sensitive material of claim 10, wherein in a silver halide emulsion of said silver halide emulsion layer, the ratio of the maximum density obtained by internal developing said silver halide emulsion to the maximum density obtained by surface developing the same is not more than 2.

12. A silver halide photographic light-sensitive material comprising a support bearing thereon at least one silver halide emulsion layer containing a yellow color-forming coupler, at least one silver halide emulsion layer containing a magenta color-forming coupler and at least one silver halide emulsion layer containing a cyan color-forming coupler, wherein at least one of said silver halide emulsion layers comprises silver halide grains comprising not less than 80 mol % of silver chloride and a water slouble iridium compound in an amount of from $10^{-8}$ to $10^{-5}$ mol per mol of silver halide contained in said silver halide emulsion layer, and said silver halide emulsion layer is hardened with at least one selected from the compounds each represented by the Following General Formula [I] and the compounds each represented by the following General formula [II]:

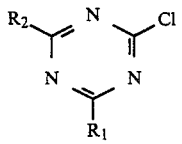

General Formula [I]

wherein $R^1$ is a chlorine atom, a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or a aryl group; and $R_2$ is a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or an aryl group, General Formula [II]

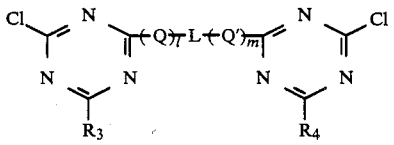

wherein $R_3$ and $R_4$ are each a chlorine atom, a hydroxy group, an alkyl group, an alkoxy group or —OM group; in which M is a monovalent metal atom; Q and Q' are each an —O—, an —S— or an —NH— group; L is an Alkylene group or an arylene group; and l and m are each 0 or 1.

13. A process for manufacturing a silver halide photographic light-sensitive material comprising a support bearing thereon at least one silver halide layer, wherein said process comprises a step of preparing a silver halide emulsion in which silver halide grains comprising not less than 80 mol % of silver chloride are formed in the presence of a water soluble iridium compound in an amount of from $10^{-8}$ to $10^{-5}$ mol per mol of silver halide containing said silver halide emulsion, a step for adding at least one selected from the group consisting of the compounds each represented by the following General Formula [I] and the compounds each represented by the following General formula [II] to said silver halide emulsion layer and a step of coating said silver halide emulsion over to on said support,

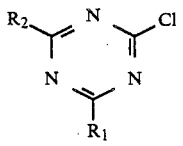

General Formula [I]

wherein $R_1$ is a chlorine atom, a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or a aryl group; and $R_2$ is a hydroxy group, an alkyl group, an alkoxy group, an alkylthio group, an —OM group, in which M is a monovalent metal atom, an —NR'R" group, in which R' and R" are each a hydrogen atom, an alkyl group or an aryl group, or an —NHCOR group, in which R is a hydrogen atom, an alkyl group or an aryl group, General Formula [II]

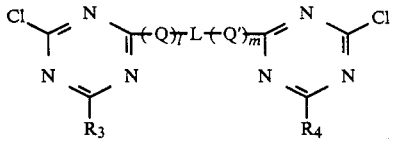

wherein $R_3$ and $R_4$ are each a chlorine atom, a hydroxy group, an alkyl group, an alkoxy group or —OM group; in which M is a monovalent metal atom; Q and Q' are each an —0—, an —S— or an —NH— group; L is an alkylene group or an arylene group; and l and m are each 0 and 1.

* * * * *